United States Patent [19]

Lehman

[11] Patent Number: 5,060,673

[45] Date of Patent: Oct. 29, 1991

[54] AGGLOMERATED MATRIX FOR CIGARETTES AND METHOD FOR MAKING SAME

[75] Inventor: Richard L. Lehman, Belle Mead, N.J.

[73] Assignee: R. J. Reynolds Tobacco Company, Winston-Salem, N.C.

[21] Appl. No.: 588,238

[22] Filed: Sep. 26, 1990

Related U.S. Application Data

[63] Continuation of Ser. No. 414,833, Sep. 29, 1989.

[51] Int. Cl.[5] ..... A24B 15/18; A24D 1/18

[52] U.S. Cl. ..... 131/359; 131/369; 44/551

[58] Field of Search ..... 131/359, 369, 342, 365; 44/16 R, 591, 607, 26

[56] References Cited

U.S. PATENT DOCUMENTS

| | | | |
|---|---|---|---|
| 3,319,630 | 5/1967 | Orrmins . | |
| 3,353,543 | 11/1967 | Sproull et al. . | |
| 3,355,317 | 11/1967 | Keith et al. | 131/342 |
| 3,484,322 | 12/1968 | Inskeep | 131/342 |
| 3,615,811 | 2/1969 | Barrett . | |
| 3,664,352 | 5/1972 | Norman et al. | 131/342 |
| 3,744,496 | 7/1973 | McCarty et al. | 131/365 |
| 4,341,228 | 7/1982 | Keritsis et al. . | |
| 4,744,987 | 5/1988 | Mehra et al. . | |
| 4,892,590 | 1/1990 | Gill et al. . | |

FOREIGN PATENT DOCUMENTS

| | | | |
|---|---|---|---|
| 0386868 | 9/1990 | European Pat. Off. . | |
| 1185887 | 3/1970 | United Kingdom | 131/359 |

OTHER PUBLICATIONS

APV Anhydro Bulletin Nos. 165 and 701.

*Primary Examiner*—V. Millin

[57] ABSTRACT

Cigarettes include tobacco-containing smokable material wrapped in a low porosity paper wrapper. The smokable material includes an intimate mixture of tobacco extract, pyrolyzed alphacellulose, agglomerated calcium carbonate particles, glycerin and carboxymethylcellulose. The agglomerated calcium carbonate particles are provided by providing an agglomerated matrix of calcium carbonate particles and organic binding agent, and calcining the organic binding agent. The resulting agglomerated matrix includes particles of calcium carbonate within a carbonaceous binding material. Such cigarettes yield low levels of incomplete combustion products and generate low levels of visible sidestream smoke.

11 Claims, 1 Drawing Sheet

AGGLOMERATED MATRIX FOR CIGARETTES AND METHOD FOR MAKING SAME

CROSS REFERENCE TO RELATED APPLICATION

This is a continuation of application Ser. No. 07/414,833 filed Sept. 29, 1989.

BACKGROUND OF THE INVENTION

The present invention relates to smoking articles such as cigarettes, and in particular to cigarettes, which when smoked, yield relatively low levels of incomplete combustion products, generate low amounts of sidestream "tar" and odor, and sustain smolder during FTC smoking conditions.

Popular smoking articles, such as cigarettes, have a substantially cylindrical rod shaped structure and include a roll or charge of smokable material, such as shredded tobacco material (e.g., in cut filler form), wrapped in a paper wrapper, thereby forming a so-called "smokable rod". Normally, a cigarette has a cylindrical filter element aligned in an end-to-end relationship with the smokable rod. Typically, a filter element includes cellulose acetate tow circumscribed by plug wrap, and is attached to the smokable rod using a circumscribing tipping material.

Typically, cigarettes are employed by the smoker by lighting one end thereof and burning the smokable rod. material, which typically is tobacco cut filler. The smoker then receives mainstream smoke (e.g., mainstream tobacco smoke) into his/her mouth by drawing on the opposite end (e.g., the filter end) of the cigarette. As such, the smoker is provided with the pleasures of smoking (e.g., smoking taste, feel, satisfaction, and the like).

During the time that the cigarette is burning, sidestream smoke is generated. Sidestream smoke is smoke which directly enters the atmosphere from the lit end of the cigarette. Sidestream smoke diffuses into the atmosphere, and the characteristic visible nature and odor thereof may be perceived negatively by some individuals. The relative amount of visible sidestream smoke generated by a burning cigarette is related to the amount of sidestream "tar" generated by that burning cigarette. Typical commercially available cigarettes which burn tobacco cut filler, and have lengths of about 84 mm (e.g., having a smokable rod length of about 57 mm and a filter element length of about 27 mm), often yield about 25 to about 35 mg of sidestream "tar" per cigarette. See, Proctor et.al., Analyst, Vol. 113, p. 1509 (1988), for an apparatus and technique for determining the sidestream "tar" of a cigarette.

Numerous cigarettes which reportedly yield relatively low levels of visible sidestream smoke have been proposed See, for example, U.S. Pat. Nos. 4,637,410 to Luke; 4,624,268 to Baker et.al.; 4,407,308 to Baker; 4,231,377 to Cline et.al.; 4,420,002 to Cline; 4,450,847 to Owens; 4,108,151 to Martin; 4,225,636 to Cline; 4,433,697 to Cline; 4,461,311 to Mathews et.al.; and 4,561,454 to Guess.

Through the years, there have been proposed various methods for altering the composition of mainstream tobacco smoke. For example, many tobacco substitute materials have been proposed, and a substantial listing of such materials can be found in U.S. Pat. No. 4,079,742 to Rainer et.al. In addition, tobacco substitute smoking materials having the tradenames Cytrel and NSM were introduced in Europe during the 1970's.

Numerous references have proposed articles which generate flavored vapor and/or visible aerosol. Most of such articles have employed a combustible fuel source to provide an aerosol and/or to heat an aerosol forming material. See, for example, the background art cited in U.S. Pat. No. 4,714,082 to Banerjee et.al.

Smoking articles which are capable of providing the pleasures associated with cigarette smoking, by heating but not necessarily burning tobacco, and without delivering considerable quantities of incomplete combustion products, are described in U.S. Pat. Nos. 4,714,082 to Banerjee et.al.; 4,756,318 to Clearman et.al.; and 4,793,365 to Sensabaugh, Jr. et.al. Such smoking articles employ a combustible fuel element for heat generation; and aerosol forming substances positioned physically separate from, and in a heat exchange relationship with, the fuel element. During use, heat generated by the fuel element acts to volatilize the aerosol forming substances, thereby providing an aerosol which resembles tobacco smoke. Such smoking articles yield extremely low levels of visible sidestream smoke as well as low levels of FTC "tar".

It would be desirable to provide a good tasting cigarette which provides good smoking satisfaction, provides relatively low mainstream gas phase yields, provides relatively low levels of incomplete combustion products, sustains smolder during FTC smoking conditions, and generates low levels of sidestream "tar" and hence low levels of visible sidestream smoke.

SUMMARY OF THE INVENTION

The present invention relates to smoking articles incorporating a tobacco material. Preferred smoking articles have the form of a cigarette having two essential components: (i) a roll or charge of tobacco-containing smokable material, and (ii) an outer wrapping material (e.g., a paper wrapper) circumscribing the roll of smokable material.

The preferred wrapping material, which surrounds the roll of smokable material to thereby form a "smokable rod", is a low air permeability cigarette paper wrapper. Highly preferred wrappers having a low air permeability or low porosity exhibit a porosity below about 5 CORESTA units. A CORESTA unit is a measure of the linear air velocity which passes through a 1 $cm^2$ area of wrapper at a constant pressure of 1 centibar. See CORESTA Publication ISO/TC 126/SC I N159E (1986).

One form of tobacco-containing smokable material which may be incorporated into a cigarette of the present invention is a reconstituted tobacco filler material which comprises an intimate mixture of (i) tobacco material, (ii) inorganic filler having a relatively low bulk density, and optionally (iii) binding agent.

Another form of tobacco-containing smokable material which may be incorporated into a cigarette of the present invention comprises an intimate mixture of (i) tobacco material, (ii) inorganic filler, and preferably an inorganic filler having a relatively low bulk density, (iii) carbonaceous material (e.g., pyrolyzed cellulose), and (iv) binding agent. The tobacco material which is incorporated within the tobacco-containing smokable material can have the form of (i) tobacco laminae, tobacco stems and tobacco dust, as is useful in providing known types of reconstituted tobacco materials, and/or (ii) tobacco extracts. Such a smokable material also may include certain flavoring agents (e.g., cocoa, menthol, etc.) and/or aerosol forming materials (e.g., glycerin).

The previously described forms of tobacco-containing smokable materials can be employed individually or as blends thereof in manufacturing cigarettes of the present invention. Furthermore, the previously described forms of tobacco-containing smokable materials can be blended with other forms of smokable materials, such as tobacco cut filler.

Another form of smokable material which may be incorporated into a cigarette of the present invention has the form of a blend of a tobacco in smokable form (e.g., a tobacco filler material including tobacco laminae cut filler or a reconstituted tobacco filler material) and a smokable material which comprises an intimate mixture of (i) carbonaceous material (e.g., pyrolyzed cellulose), (ii) inorganic filler material, and preferably in inorganic filler having a relatively low bulk density, and (iii) binding agent. The smokable material which is blended with the tobacco filler material may include flavoring agents and/or visible aerosol forming materials.

DETAILED DESCRIPTION OF THE PREFERRED EMBODIMENTS

Figure 1:
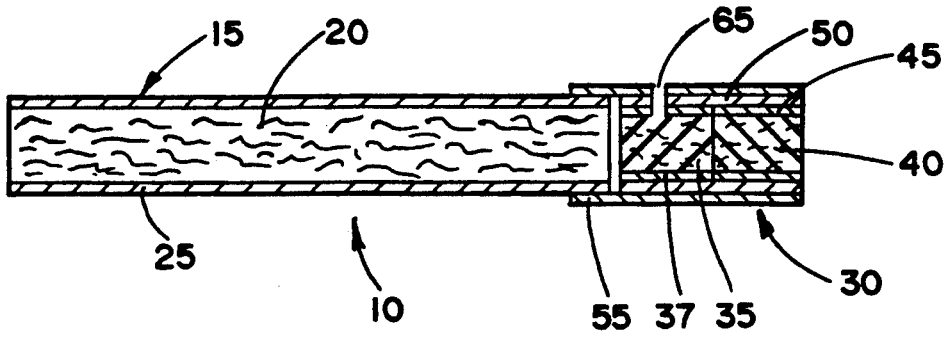
FIGS. 1 through 3 are longitudinal sectional views of smoking articles of the present invention.

A preferred embodiment of a cigarette of the present invention is shown in FIG. 1. The cigarette 10 includes a generally cylindrical rod 15. The rod includes a roll of smokable material 20 wrapped in at least one layer of circumscribing outer wrapping material 25 (e.g., paper). The rod 15 is hereinafter referred to as a "smokable rod". The ends of the smokable rod 15 are open to expose the smokable material. The smokable rod is used by lighting one end thereof, and smoke is provided as a result of the combustion of the burning smokable material. As such, the smokable rod burns from the lit end thereof towards the opposite end thereof.

The cigarette 10 also includes a filter element 30 positioned adjacent one end of the smokable rod 15 such that the filter element and smokable rod are axially aligned in an end-to-end relationship, preferably abutting one another. Filter element 30 has a generally cylindrical shape, and the diameter thereof is essentially equal to the diameter of the smokable rod. The ends of the filter element are open to permit the passage of air and smoke therethrough. The preferred filter element has at least two filter segments. As shown in FIG. 1, a first filter segment is positioned adjacent the smokable rod, and preferably includes a carbonaceous filter material 35 circumscribed by a wrapping material 37; while a second filter segment is positioned at the extreme mouthend of the cigarette, and preferably includes a filter material 40, such as a gathered non-woven polypropylene web or cellulose acetate tow, circumscribed by a wrapping material 45. The filter material 40 of the segment preferably is a material which provides an aesthetically pleasing, white appearance. Each of the filter segments is manufactured using known filter rod making machinery. The two segments are combined using known plug tube combining techniques, and are held together using circumscribing wrap 50 so as to form the filter element.

The filter element 30 normally is attached to the smokable rod 15 by tipping material 55, which circumscribes both the entire length of the filter element and an adjacent region of the smokable rod. The inner surface of the tipping material 55 is fixedly secured to the outer surface of the plug wrap 50 and the outer surface of the wrapping material 25 of the smokable rod, using a suitable adhesive. The cigarette 10 can be manufactured using known cigarette making techniques and equipment. Optionally, a ventilated or air diluted cigarette is provided with an air dilution means such as a series of perforations 65 which extend through the tipping material 55, plug wrap 50 and wrapping material 37. Such ventilation can be provided to the cigarette using known techniques, such as laser perforation techniques.

Figure 2:
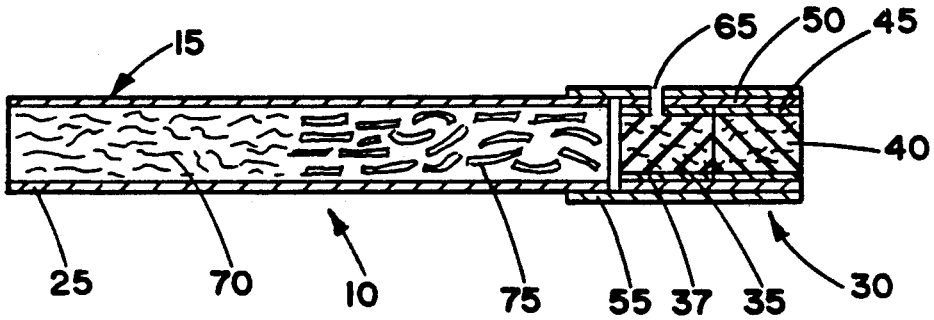

Another preferred embodiment of a cigarette of the present invention is shown in FIG. 2. The cigarette 10 is generally similar to the cigarette described with reference to FIG. 1, except that the smokable material has the form of a blend which is provided in a segmented fashion. At one end of the smokable rod 15 (i.e., at the end of the cigarette to be lit) is located a first segment 70 of smokable material. At the other end of the smokable rod 15 (i.e., at the filter end of the smokable rod) is located a second segment 75 of smokable material. Each segment is defined or identified in terms of its composition (i.e., the composition of each segment is different). The segments are aligned in an abutting, end-to-end relationship; however, there can be a certain amount of intermixing of smokable materials in the region where the two segments meet. The length which each segment of smokable material extends along the smokable rod can vary. However, the relative longitudinal length of the first segment relative to the second segment normally ranges from about 1:2 to about 2:1, with about 1:1 being preferred. Such smokable rods can be manufactured using apparatus described in U.S. Pat. Nos 4,009,722 to Wahle et.al. and 4,516,585 to Pinkham.

For preferred cigarettes of the type shown in FIG. 2, the first segment 70 is composed of tobacco in a smokable form. Such a form of tobacco includes tobacco laminae, processed tobacco materials, volume expanded tobacco filler, reconstituted tobacco filler materials, and the like; blends thereof; and blends thereof with other smokable materials. An example of a processed tobacco material is a deproteinated reconstituted tobacco material described in U.S. Pat. application Ser. No. 195,985, filed May 19, 1988, which is incorporated herein by reference. Preferred cigarettes also have a second segment 75 which includes a smokable material or blend of smokable materials different in composition from the smokable material of the first segment 70. An example of a smokable rod 15 includes a first segment 70 which includes a blend of 1 weight part deproteinated reconstituted tobacco filler material and 3 weight parts of a smokable filler material comprising an intimate mixture of carbonaceous material, calcium carbonate, glycerin and binding agent; and a second segment 75 which includes a blend of 1 weight part deproteinated reconstituted tobacco filler material and 9 weight parts of a smokable filler material comprising an intimate mixture of carbonaceous material, calcium carbonate, glycerin and binding agent.

Figure 3:
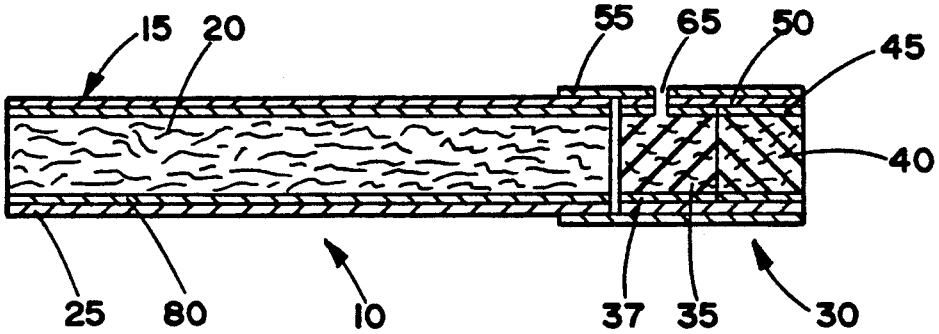

Another preferred embodiment of a cigarette of the present invention is shown in FIG. 3. The cigarette 10 is generally similar to the cigarette described with reference to FIG. 1, except that the smokable material 20 is wrapped or contained in a processed tobacco sheet 80. The processed tobacco sheet 80 normally is a reconstituted tobacco sheet which is manufactured using a papermaking process, and a single layer of the sheet circumscribes the smokable material 20. The smokable material 20 wrapped in the processed tobacco sheet 80 is in turn wrapped in a single layer of circumscribing outer wrapping material 25 (e.g., cigarette paper).

The smokable material employed in the manufacture of the smokable rod can vary, and most preferably has the form of filler (e.g., cut filler). As used herein, the terms "filler" or "cut filler" in referring to smokable materials are meant to include smokable materials which have a form suitable for use in the manufacture of smokable rods for cigarettes. As such, filler can include smokable materials which are blended and are in a form ready for cigarette manufacture. Smokable filler materials normally are employed in the form of strands or shreds as is common in cigarette manufacture. For example, cut filler material can be employed in the form of strands or shreds from sheet-like or "strip" materials. Such strip materials are cut into widths ranging from about 1/5 inch to about 1/60 inch, preferably from about 1/30 inch to about 1/40 inch. Generally, the resulting strands or shreds have lengths which range from about 0.25 inch to about 3 inches.

One type of smokable material comprises an intimate mixture of carbonaceous material, binding agent and inorganic filler material. Such a smokable material preferably includes as part of the intimate mixture, at least one aerosol forming material and/or at least one flavoring agent. Such a smokable material normally includes about 30 to about 70, preferably about 35 to about 60 weight percent inorganic filler material; about 10 to about 60, preferably about 10 to about 30 weight percent carbonaceous material; up to about 10, preferably about 2 to about 8 weight percent binding agent; up to about 10, preferably about 3 to about 8 weight percent aerosol forming material; and sufficient amounts of flavoring agent to provide the desired flavor characteristics. Such a smokable material can be employed with (e.g., blended with) tobacco in smokable form in order to provide a cigarette of the present invention.

One type of tobacco-containing smokable material comprises an intimate mixture of tobacco material, carbonaceous material, binding agent and inorganic filler material. Such a tobacco-containing smokable material preferably includes as part of the intimate mixture, at least one aerosol forming material and/or at least one flavoring agent. Such a tobacco-containing smokable material normally includes up to about 25, typically up to about 20 weight percent tobacco material; about 30 to about 70, preferably about 35 to about 60 weight percent inorganic filler material; about 10 to about 60, preferably about 10 to about 30 weight percent carbonaceous material; up to about 10, preferably about 2 to about 8 weight percent binding agent; up to about 10, preferably about 3 to about 8 weight percent aerosol forming material; and sufficient amounts of flavoring agent to provide desired flavor characteristics.

Typically, the previously described types of smokable materials are provided by forming an aqueous slurry of the components of the smokable material, casting the slurry as a sheet, and drying the cast material to form a relatively dry workable sheet. A material such as calcium acetate or calcium hydroxide can be incorporated into the slurry. The cast material can be dried at ambient temperatures or at elevated temperatures. The resulting dried sheet can be cut or broken into "strip" form, and later can be cut or shredded into cut filler form.

It is preferable to incorporate a caramelizing material into the previously described types of smokable materials. Caramelizing materials act to improve the contiguity and integrity of the ash and fire cone of the cigarette. The caramelizing material can be incorporated into the smokable material during the preparation of the smokable material and/or applied to the surface of the smokable material after the smokable material has been manufactured. Normally, the amount of caramelizing material which is employed to treat a particular smokable material is such that the resulting smokable material which incorporates the caramelizing material includes about 5 to about 20 weight parts of caramelizing material and about 80 to about 95 weight parts of the smokable material which is treated. Examples of suitable caramelizing materials include sugars, such as glucose, fructose and sucrose; and compositions such as Carob Powder Code 1739 from M. F. Neal, Inc.

The previously described types of smokable materials incorporate carbonaceous material (i.e., a material consisting primarily of carbon) therein. Such a material is a combustible material, and most preferably is derived from natural cellulosic materials. Natural cellulosic materials preferably have a high cellulose content (i.e., a cellulose content above about 80 weight percent). Examples of natural cellulosic materials include cotton fibers, cotton linters, hardwood pulp and softwood pulp. Typical combustible carbonaceous materials are provided by pyrolyzing a natural cellulosic material under inert atmosphere at temperatures between about 600° C. and about 1,200° C. Such carbonaceous materials normally exhibit a surface area of less than about 500 $m^2/g$, as determined using the Dubinin-Polanyi method described by Lamond and Marsh, Carbon, Vol. 1, p. 281 and p. 293 (1964). Such carbonaceous materials can be activated in an oxidizing environment (e.g., under carbon dioxide or steam) to increase the surface area and/or porosity thereof). Preferred combustible carbonaceous materials include at least about 80 weight percent carbon.

The previously described tobacco-containing smokable material has some form of tobacco material incorporated therein during its manufacture. The tobacco material which is employed to provide such a tobacco-containing smokable material can have a variety of forms, including tobacco extracts, tobacco dust, tobacco laminae, tobacco stems, processed tobacco filler, and the like. Tobacco extracts are provided by extracting a tobacco material using a solvent such as water, carbon dioxide, a hydrocarbon, or a halocarbon, as well as various other organic and inorganic solvents. Tobacco extracts can include spray dried extracts; tobacco essences, such as those essences described in European Patent Application No. 326,370; and aroma oils and extracts described in U.S. Pat. No. 4,506,682 to Mueller and U.S. Pat. application Ser. No. 310,413, filed Feb. 13, 1989.

The previously described types of smokable materials incorporate a binding agent. Examples of suitable binding agents include hydroxypropylcellulose such as Klucel H from Aqualon Co.; hydroxypropylmethylcellulose such as Methocel K4MS from The Dow Chemical Co.; hydroxyethylcellulose such as Natrosol 250 MRCS from Aqualon Co.; microcrystalline cellulose such as Avicel from FMC; methylcellulose such as Methocel A4M from The Dow Chemical Co.; and carboxymethylcellulose such as CMC 7HF and CMC 7H4F from Hercules Inc. Other binding agents include corn starch, guar gum, locust bean gum, pectins and alginates. If desired, pectin release agents (e.g., diammonium hydrogen orthophosphate) can be employed during the manufacture of the previously described reconstituted tobacco material in order to release tobacco pectins which exhibit adhesive characteristics. Combinations or blends of binding agents (e.g., a mixture of guar gum and locust bean gum) can be employed.

The previously described types of smokable materials can have at least one aerosol forming material and/or at least one flavoring agent incorporated therein. The preferred aerosol forming materials include glycerin, propylene glycol, and any other materials which yield a visible aerosol. The flavoring agents can vary, and include menthol, vanillin, citric acid, malic acid, levulinic acid, cocoa, licorice, and the like, as well as combinations thereof.

The previously described types of smokable materials incorporate inorganic filler material therein. Typical inorganic filler materials can have a fibrous, flake, crystalline, hollow or particulate form. Examples of inorganic filler material include calcium carbonate, calcium sulfate, magnesium oxide, magnesium hydroxide, perlite, synthetic mica, vermiculite, clays, thermally stable carbon fibers, zinc oxide, dawsonite, low density hollow spheres of calcium carbonate, glass spheres, glass bubbles, thermally stable carbon microspheres, calcium sulphate fibers, hollow ceramic microspheres, alumina, and the like. Desirable inorganic materials do not provide, to any significant degree, an undesirable off-taste to the mainstream cigarette smoke during use of the cigarette. Preferred inorganic materials exhibit a bulk density beloW about 2 g/cm$^3$, more preferably below about 1 g/cm$^3$. One preferred inorganic material has the form of glass bubbles which are available as Code 25P35 from Potter's Industries. Another inorganic material is available as Extendospheres XOL-200 from PQ Corp. A most preferred inorganic material has the form of agglomerated calcium carbonate particles.

The preferred inorganic filler material has the form of an agglomerated matrix of inorganic material. A particularly preferred inorganic filler material is agglomerated calcium carbonate, and most preferably, agglomerated precipitated calcium carbonate. Such materials are prepared by providing an aqueous slurry of calcium carbonate particles and a binding material, and drying the slurry to form an agglomerated matrix of calcium carbonate (i.e., a matrix of a plurality of calcium carbonate particles spaced within a continuous or semi-continuous phase of binding agent). Calcium carbonate particles which are employed to provide the agglomerated matrix typically exhibit a surface area of less than about 1 m$^2$/g, as determined using the BET method. Typical binding materials are organic materials, such as cellulosic derivatives (e.g., sodium carboxymethylcellulose), and preferably are sugar containing materials, such as molasses, high fructose corn syrup, or Carob Powder Code 1739 from M. F. Neal, Inc. Preferably, a high solids content aqueous slurry of calcium carbonate and binding material is spray dried to provide agglomerated particles (e.g., normally spherical particles) of calcium carbonate particles and binding material. Alternatively, the slurry can be dried by the application of heat to provide a solid mass of agglomerated calcium carbonate and binding material, and the solid mass can be ground to yield particles of the desired size. Preferably, the amount the calcium carbonate relative to binding material ranges from 2 to about 5:1, more preferably about 10:1 to about 15:1, on a dry weight basis.

The agglomerated matrix of inorganic filler material and organic binding material is subjected to heat treatment. As such, volatile components from the organic binding material are expelled, and the organic binding material is calcined to form a water insoluble, carbonaceous material. Normally, the heat treatment of the agglomerated matrix is provided under controlled atmosphere, in order to minimize or prevent oxidation of the binding material. Preferably, the heat treatment provides a binding material which is carbonaceous, and in turn, provides a means for agglomerating the inorganic filler particles into a matrix form. In particular, the agglomerated calcium carbonate and binding agent particles can be heat-treated using an oven, a fluidized bed, rotary calciners, belt calciners, or the like. For example, spray dried calcium carbonate particles agglomerated using molasses can be heated in a fluidized bed having gaseous nitrogen heated at about 300° C. to about 425° C. flowing therethrough, and collected. After the calcining process, the agglomerated calcium carbonate particles normally have a calcium carbonate content of greater than about 90 weight percent. Normally, the resulting agglomerated particles are screened to sizes of about −100 to +325 US Mesh. Preferred agglomerated calcium carbonate particles which have been calcined are spherical in shape, are free flowing, and exhibit a bulk density of about 0.75 g/cm$^3$ to about 0.95 g/cm$^3$. As such, agglomerated calcium carbonate particles provide an inorganic filler material having a bulk density less than about 2 g/cm$^3$, and preferably less than about 1 g/cm$^3$, which includes an inorganic material having a bulk density greater than about 2.5 g/cm$^3$. Normally, such agglomerated calcium carbonate particles exhibit a surface area of less than about 15 m$^2$/g, and often less than about 10 m$^2$/g, as determined using the Brunaver, Emmett and Teller (BET) method described in *J. Am. Chem. Soc.*, Vol. 60, p. 309 (1938).

Cigarettes of the present invention often include a blend of smokable materials. Preferred cigarettes include within such a blend, a sufficient amount of at least one of the previously described types of smokable materials such that the smokable material within each cigarette comprises at least about 9 percent of the carbonaceous material, based on the total weight of the blend. In particular, cigarettes having low porosity paper outer wrappers (e.g., having outer wrappers having less than about 5 CORESTA units) and having very low levels of carbonaceous material, can have the propensity to not sustain smolder (e.g., self-extinguish), when smoked under FTC smoking conditions. FTC smoking conditions consist of 35 ml puffs of 2 second duration, taken every 60 seconds. However, cigarettes having overly high levels of carbonaceous material within the smokable material can have the propensity to have overly long fire cones, especially when wrapping materials having porosities above about 3 CORESTA units are employed.

The composition of the previously described types of smokable materials can govern the quality and appearance of the ash and fire cone of the cigarette during use. To provide a cigarette having an ash and fire cone which is not overly cohesive and hence overly long, it is desirable that the smokable material comprise a sufficiently high amount of inorganic filler material. However, the amount of inorganic filler within the smokable material, and the amount of that smokable material present within the cigarette is such that (i) the cigarette weight is not excessive (i.e., due to a high level of inorganic filler), (ii) the cigarette achieves a burn rate which is acceptable, (iii) the ash and fire cone of the cigarette exhibit good contiguity and integrity, and (iv) the cigarette provides a fire cone which is not overly long (i.e., due to a low level of inorganic filler).

Smokable materials can be cased and top dressed as is conventionally performed during various stages of cigarette manufacture. For example, flavoring agents can be applied to the smokable material as is commonly performed when cigarette cut filler is processed. Suitable flavoring agents include vanillin, cocoa, licorice, menthol, and the like. Flavor modifying agents, such as levulinic acid, can be applied to the smokable material (e.g., in amounts ranging from about 0.01 to about 2 percent, normally from about 0.1 to about 1 percent, preferably about 0.2 to about 0.6 percent, based on the dry weight of the smokable material). Aerosol forming materials, such as glycerin and propylene glycol, can be applied to the smokable material. Such components conveniently are applied to the smokable material as casing and top dressing components.

A preferred cigarette of the present invention includes (a) a tobacco-containing smokable material including at least about 90 weight percent thereof of a smokable filler material which includes an intimate material, (iii) inorganic filler material, (iv) binding agent, and (v) aerosol forming material, and (b) a low porosity wrapper circumscribing the smokable material.

Yet another type of smokable material is a reconstituted tobacco material which comprises an intimate mixture of tobacco filler material, inorganic filler material having a bulk density below about 2 g/cm$^3$, more preferably below about 1 g/cm$^3$, and an optional binding agent. Such a reconstituted tobacco material normally includes about 20 to about 60 weight percent inorganic filler material, and about 40 to about 80 weight percent tobacco filler material. Examples of suitable inorganic filler materials are set forth hereinbefore with reference to the previously described smokable materials. The smokable material typically is provided by forming an aqueous slurry of the components of the smokable material, casting the slurry as a sheet, and drying the cast sheet to form a relatively dry, workable sheet. A binding agent typically is employed when the slurry of components is cast as a sheet to form the smokable material. Examples of suitable binding agents are set forth hereinbefore with reference to the previously described smokable materials. The smokable material also can be provided using a papermaking process. When a papermaking process is employed to form the reconstituted tobacco material, a binding agent typically is not employed; however, in such an instance, a small amount (e.g., up to about 5 percent, based on the dry weight of the ultimate reconstituted tobacco material) of flax fibers can be incorporated into smokable material during the preparation thereof. As used herein, the term "tobacco filler material" is meant to include natural tobacco material components, that under extraction conditions at ambient conditions using water, have a water soluble (i.e., extractable) portion and a water insoluble (i.e., non-extractable, cellulosic) portion. The tobacco filler material can be provided in the form of tobacco laminae; tobacco stems; tobacco processing by-products such as tobacco dust; processed tobacco materials including previously reconstituted tobacco materials; and the like. The tobacco type can vary, and can include flue-cured, Burley, Md. or Oriental tobacco materials, or blends thereof.

The previously described types of smokable materials can be blended with tobacco filler materials. Such tobacco filler materials can be provided in the form of tobacco laminae; volume expanded or puffed tobacco laminae; processed tobacco stems such as cut-rolled or cut-puffed stems; reconstituted tobacco materials, such as (i) a deproteinated tobacco material described in U.S. Pat. application Ser. No. 195,985, filed May 19, 1988, (ii) a phosphate-containing reconstituted tobacco material described in U.S. Pat. Nos. 3,353,541 and 3,420,241 to Hind et.al., and 3,386,449 to Hind, or (iii) a reconstituted tobacco material described in *Tobacco Encyclopedia,* edit by Voges, p. 389, TJI (1984); or blends thereof.

The preferred wrapping material which provides the smokable rod is a cigarette wrapping material having a low air permeability value. Such a wrapping material normally has an air permeability of less than about 5 CORESTA units, often less than about 3 CORESTA units, and frequently less than about 1 CORESTA unit. Typical wrapping materials are cigarette wrapping papers. Suitable wrapping materials are cigarette paper wrappers available as DD-71-1, DD-71-6 and DD-100-2 from Kimberly-Clark Corp. Suitable low porosity cigarette paper wrappers are commercially available, and can have various levels of burn chemicals, fluxing agents, etc., incorporated therein. Particularly preferred are cigarette paper wrappers which include an amount of a polymeric film forming agent sufficient to provide a paper having the desirably low air permeability value. For example, a sufficient amount of a solution of a polymeric film forming agent can be applied to a paper wrapper. The selection of the polymeric film forming agent will be apparent to the skilled artisan.

The optional polymeric film forming agent can be applied to the paper wrapper during the manufacture of the paper, or applied as a print or paint after manufacture of the paper is complete. Typically, the film forming agent is applied to the paper as a dilute solution (e.g., at a concentration of about 0.2 to about 5 weight percent relative to the solvent) for ease of processing. The amount of film forming agent applied to the paper wrapper depends upon factors such as the permeability of the paper and the film forming capabilities of the film forming agent. Typically, the amount of film forming agents employed ranges from about 1 to about 10 percent, based on the dry weight of the For example, a 5 weight percent solution of ethylcellulose in ethanol can be applied to cigarette paper using a size press, and the paper can be dried to provide a non-wetting, moisture resistant paper wrapper having a porosity of less than 1 CORESTA unit, preferably less than 0.5 CORESTA unit.

The smokable rods and the resulting cigarettes can be manufactured in any known configuration using known cigarette making techniques and equipment. Smokable rods normally include smokable material wrapped in a single layer of wrapping material, although a double layer of wrapping material can be employed.

Typically, the smokable rod has a length which ranges from about 35 mm to about 70 mm, preferably about 40 to about 60 mm; and a circumference of about 17 mm to about 27 mm, preferably about 22 mm to about 25 mm. Short smokable rods (i.e., having lengths from about 35 to about 50 mm) can be employed, particularly when smokable blends having a relatively high packing density are employed.

The packing density of the smokable material contained within the outer wrapping material can vary. Typical packing densities for smokable rods of cigarettes of the present invention range from about 150 to about 400 mg/cm$^3$. Normally, packing densities of such smokable rods range from about 200 to about 280 mg/cm$^3$, frequently about 250 to about 275 mg/cm$^3$, particularly when relatively short (i.e., less than 50 mm long) smokable rods are employed.

The cigarettes of the present invention preferably include a filter element, and most preferably a filter element having more than one segment. For example, a preferred filter element has two or more filter segments. Typically, the segments of the preferred filter elements each have lengths which ranges from about 10 mm to about 30 mm; and circumferences of about 17 mm to about 27 mm, preferably about 22 mm to about 25 mm. The plug wrap which circumscribes the filter material of each filter segment typically is a conventional paper plug wrap, and can be either air permeable or essentially air impermeable.

Preferred filter materials of one of the filter segments include carbonaceous materials (e.g., activated carbon particles, charcoal particles, or carbon paper). An example of a particularly preferred filter material is provided by gathering a carbon paper available as P-144-BAC from Kimberly-Clark Corp. Such filter materials reduce the levels of certain gas phase components from the mainstream smoke which passes to the mouth of the smoker. As such, preferred filter materials of that segment act to reduce the levels of any smoke components which may provide an off-taste to the mainstream smoke.

Preferred filter materials of another of the filter segments normally include fibrous materials. An example of a suitable filter material is a gathered nonwoven polypropylene web. A particularly preferred nonwoven polypropyle like web is available as PP-100-F from Kimberly-Clark Corp.

Another filter segment can have a filter material in the form of a gathered web of nonwoven thermoplastic (i.e., hydrophobic) fibers in intimate contact with a water soluble tobacco extract so as to provide an extract-containing filter material. A highly preferred web is a nonwoven web of polypropylene fibers available as PP 200 SD from Kimberly-Clark Corp. Such a web can be manufactured by a melt blowing process as is described in U.S. Pat. No. 3,849,241 to Buntin et.al. Water soluble tobacco extracts are provided by extracting a tobacco material with a solvent having an aqueous character (i.e., a solvent consisting primarily of water, preferably greater than 90 weight percent water, and most preferably essentially pure water). The specific composition of the tobacco extract can vary, depending upon factors such as the type of tobacco material which is extracted and the type of extraction conditions. Extract-containing filter materials also include a minor amount of a lubricating substance, such as a polyhydric alcohol (e.g., glycerin, propylene glycol, or the like). The lubricating substance provides flexibility to the web, and provides a web which can be shaped without the application of heat. Typical extract-containing filter materials include about 5 to about 55, preferably about 10 to about 30, weight percent water soluble tobacco extract, and up to about 10 percent lubricating substance, based on the total weight of the extract-containing filter material. Typical extract-containing filter materials are manufactured by providing an aqueous mixture of extract and lubricating substance, applying the liquid to a web of nonwoven thermoplastic fibers using a rotogravure process, and drying the web. If desired, the tobacco extract can be a spray dried extract, a freeze dried extract or a tobacco essence, and in turn dissolved in water. Methods for providing and processing extracts are set forth in European Patent Application No. 326,370. Typically, the tobacco extract contained within the nonwoven thermoplastic web has a moisture content of about 5 to about 6 weight percent, although the moisture content of a particular tobacco extract can vary.

Yet another filter segment can include a tobacco paper material as the filter material. For example, a filter material can have the form of a gathered web of tobacco paper available as P144-B from Kimberly-Clark Corp.

The filter element segments suitable for use in this invention can be manufactured using known cigarette filter making techniques. Filter elements can be manufactured from carbon paper, tobacco paper and a sheet-like nonwoven polypropylene web using filter making techniques described in U.S. Pat. No. 4,807,809 to Pryor et.al., which is incorporated herein by reference. Alternatively, particles of charcoal or activated carbon can be incorporated into the filter element using a so-called "triple filter" configuration by positioning the particles between two segments of suitable filter materials.

Preferred filter elements have minimal mainstream aerosol (i.e., smoke) removal efficiencies while maintaining the desirable draw characteristics of the cigarette. Such minimal smoke removal efficiencies are provided by "low efficiency" filter elements. Low efficiency filter elements have a minimal ability to remove mainstream smoke particulates. See, Keith in Schemeltz's *The Chemistry of Tobacco and Tobacco Smoke*, p. 157 (1972). Generally, low efficiency filter elements provide less than about 40 weight percent mainstream smoke particulate removal efficiency.

Tipping material circumscribes the filter element and an adjacent region of the smokable rod such that the tipping material extends about 3 mm to about 6 mm along the length of the smokable rod. Typically, the tipping material is a conventional paper tipping material. Tipping materials of varying porosities can be employed. For example, the tipping material can be essentially air impermeable, air permeable, or treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

For air diluted or ventilated cigarettes of the present invention, the amount of air dilution can vary. Preferably, the amount of air dilution for a cigarette is greater than about 25 percent, more preferably greater than about 40 percent. The upper limit for air dilution for a cigarette typically is less than about 75 percent, more frequently less than about 65 percent. As used herein, the term "air dilution" is the ratio (expressed as a percentage) of the volume of air drawn through the air dilution means to the total volume of air and aerosol (i.e., smoke) drawn through the cigarette and exiting the extreme mouthend portion of the cigarette. See, Selke et. al., *Beitr. Zur Tabak. In.*, Vol. 4, p. 193 (1978).

Cigarettes of the present invention, when smoked, generally yield less than about 20 mg, preferably less than about 10 mg of sidestream "tar" per cigarette, as determined using the apparatus and techniques described by Proctor et.al., *Analyst.* Vol. 113, p. 1509 (1988). Such cigarettes normally provide more than about 5 puffs, preferably more than about 6 puffs per cigarette, when smoked under FTC conditions. Normally, cigarettes of the present invention provide less than about 15 puffs, and often less than about 10 puffs, when smoked under FTC conditions.

The following examples are provided in order to further illustrate the invention but should not be construed as limiting the scope thereof. Unless otherwise noted, all parts and percentages are by weight.

EXAMPLE 1

A. Preparation of a Tobacco-Containing Smokable Filler Material

A carbonaceous material is provided as follows:

Cotton fibers (i.e., non-tobacco material) having an alpha-cellulose content greater than 90 percent are heated in a closed oven under nitrogen atmosphere. After about 2.5 hours of heating, the temperature in the oven reaches about 650° C. The temperature within the oven is held at about 650° C. for about 1 hour, while the atmosphere is maintained under nitrogen atmosphere. Then, the heating is ceased, and the temperature within the oven cools to ambient temperature in about 4 hours, while an atmosphere of nitrogen is maintained within the oven. The heated (i.e., pyrolyzed) cotton fibers are black in color, and have undergone a weight loss of about 80 percent. The pyrolyzed cotton fibers (i.e., carbonaceous material) have a carbon content of about 92 percent.

An inorganic filler material is provided as follows:

Into a low shear mixer are charged about 48 parts tap water at ambient temperature, 38 parts precipitated calcium carbonate available as Albacar 7951 from Pfizer Inc., and about 14 parts molasses. The molasses is available from Savannah Sugar Co., and has a solids/-water content of about 50:50. The resulting mixture is agitated for about 5 to about 10 minutes to provide a slurry having a solids content of about 45 percent.

The slurry is spray dried by continuously pumping the slurry at about 0.5 to about 0.8 lb./min. to a spray dryer. The spray dryer is about 3 feet in diameter, and has a height of about 5.7 feet, excluding cone, and has a Bowen SS-5J nozzle and nozzle openings of about 0.03 inch. The inlet temperature of the spray dryer is about 450° F., and the outlet temperature is about 250° F. The resulting spray dried particles have a generally spherical shape, and a moisture content of about 2 percent.

About 600 g of the spray dried particles are charged into a crucible, and the crucible is covered with aluminum foil, and placed into a furnace. The furnace then is maintained at about 350° C. for about 2 hours. The heated particles are removed from the furnace, cooled to ambient temperature, and screened to a particle size of −120 to +230 US Mesh.

The particles so collected have a light brown color, are spherical in shape, are free flowing, and resist wetting. The particles are about 93 percent calcium carbonate, and exhibit a bulk density of 0.5 g/cm$^3$. The particles each are an agglomerated matrix of a plurality of precipitated calcium carbonate particles spaced within a carbonaceous material.

The smokable material is provided as follows:

Into tap water at ambient temperature and maintained at high shear in a blender is charged 5.6 parts sodium carboxymethylcellulose available as CMC 7HF from Hercules Inc. Then, 8.4 parts glycerin is charged into the mixture. After a consistent slurry is provided, 4.55 parts tobacco extract available as SwissArome Virginia from Burger & Sohn, and 3.2 parts malic acid are charged into the mixture. The tobacco extract and malic acid are provided at a concentration of about an 18 percent within an ethanol solvent. Then, 5.6 parts fructose, 2.8 parts glucose and 0.7 parts levulinic acid are charged into the mixture. The sugars and levulinic acid are provided as a solution in 35 parts hot water. Then, 32.2 parts of the previously described carbonaceous material is folded into the mixture so as to provide a thick, black slurry. Then, 73.15 parts of the previously described inorganic filler is folded into the mixture. The resulting slurry, which is an intimate mixture of the aforementioned components, has a solids content of about 30 percent, and exhibits a pH of about 6 to about 8.

The slurry is cast to a 0.03 inch thickness onto a high density polyethylene sheet and air dried. The resulting tobacco-containing smokable material is a black sheet having (i) a thickness of about 0.012 inch, (ii) a density of about 0.473 g/cm$^3$, (iii) a moisture content of about 6 to about 10 percent, and (iv) a flexible and pliable character. The sheet is provided in strip form, about 2 inches by about 3 inches in size. The strips are shredded at 32 cuts per inch to provide a smokable cut filler. The shreds of filler are dusted with a caramelizing material. In particular, the smokable filler is contacted with Carob Powder Code 1739 from M. F. Neal, Inc., such that about 5 percent of the resulting smokable material is caramelizing material.

B. Preparation of a Cigarette

Cigarettes substantially as shown in FIG. 1 are provided as follows:

The cigarettes each have a length of 90 mm and a circumference of 24.8 mm, and include a smokable rod having a length of 50 mm, a first filter segment having a length of 30 mm and a second filter segment having a length of 10 mm. Each filter segment is attached to each smokable rod using nonporous tipping paper. For each cigarette, the tipping paper circumscribes the filter element and a 4 mm length of the smokable rod in the region adjacent the filter element. The filter elements are not ventilated.

The smokable rod includes the previously described tobacco-containing smokable material in cut filler form.

The first filter segment is provided by gathering a 11.75 inch wide web of carbon paper available as P-144-BAC from Kimberly-Clark Corp. using the filter rod forming apparatus described in Example 1 of U.S. Pat. No. 4,807,809 to Pryor et.al. The plug wrap for the filter segment is available as Reference No. 5831 from Ecusta Corp. The first filter segment is positioned adjacent the smokable rod.

The second filter segment is provided by gathering a 11.75 inch wide web of non-woven polypropylene web available as PP-100-F from Kimberly-Clark Corp. using the filter rod forming apparatus described in Example 1 of U.S. Pat. No. 4,807,809 to Pryor et.al. The plug wrap for the filter segment is available as Reference No. 5831 from Ecusta Corp. The second filter segment is positioned adjacent the first filter segment, at the extreme mouth end of the cigarette.

The cigarette paper wrap exhibits an air permeability of less than 1 CORESTA unit. The cigarette paper is provided by applying a 5 percent solution of ethylcellulose in ethanol to a cigarette paper wrapper available as DD-100-2 from Kimberly-Clark Corp., and drying the resulting paper. No further burn enhancing agents are incorporated into the cigarette paper.

Smokable cigarette rods are provided using known techniques. In particular, the smokable material is circumscribed by a single layer of paper wrap. The weight of the smokable material within each cigarette rod is about 0.88 g.

The cigarettes are employed by burning the smokable rod such that the smokable material within the paper wrapper burns to yield smoke. When employed, such cigarettes yield very low levels of visible sidestream smoke and essentially no sidestream odor. Cigarettes smoked and tested in this manner each yield 8.0 puffs, 18.7 mg wet total particulate matter (WTPM), 1.8 mg nicotine, 4.8 mg water and 4.8 mg glycerin, under FTC smoking conditions. The cigarettes each yield 12.1 mg FTC "tar" (of which 4.8 mg is glycerin). The cigarettes do not self-extinguish during the smolder period experienced during FTC smoking conditions.

EXAMPLE 2

A. Preparation of a Tobacco-Containing Smokable Filler Material

Into tap water at ambient temperature and maintained at high shear in a blender is charged 5.6 parts sodium carboxymethylcellulose available as CMC 7HF from Hercules, Inc. Then, 8.4 parts glycerin is charged into the mixture. After a consistent slurry is provided, into the mixture is charged (i) 4.55 parts of the tobacco extract described in Example 1 and 3.2 parts malic acid in 35 parts ethanol; and (ii) 5.6 parts fructose, 2.8 parts glucose, 0.7 parts levulinic acid and 7.0 parts Carob Powder Code 1739 from M. F. Neal, Inc. in 50 parts hot water. Then, 32.2 parts of the carbonaceous material described in Example 1 is folded into the mixture. Then, 73.15 parts of calcium carbonate available from Georgia Marble Co. and screened to −80 to +170 US Mesh is folded into the mixture. The resulting slurry is cast to a 0.030 inch thickness onto a high density polyethylene sheet and air dried. The resulting material is a black sheet having a thickness of about 0.012 inch, a density of about 0.571 g/cm$^3$, and a moisture content of about 6 to about 10 percent. The sheet is cut into strip form, about 2 inches by about 3 inches in size. The strips are shredded at 32 cuts per inch, and dusted with caramelizing material, in the manner described in Example 1.

B. Preparation of a Cigarette

The cigarettes each have a length of 84 mm and a circumference of 24.8 mm, and include a smokable rod having a length of 57 mm, a first filter segment having a length of 15 mm and a second filter segment having a length of 12 mm. Each filter element is attached to each smokable rod using nonporous tipping paper. For each cigarette, the tipping paper circumscribes the filter element and a 4 mm length of the smokable rod in the region adjacent the filter element. The filter elements are not ventilated.

The cigarettes are provided using the wrapping materials and filter materials described in Example 1.

The cigarettes are employed by burning the smokable rod such that the blend of smokable material within the paper wrapper burns to yield smoke. When employed, such cigarettes yield very low levels of visible sidestream smoke and essentially no sidestream odor. Cigarettes smoked and tested in this manner yield 7.3 puffs, 30.0 mg WTPM, 3.3 mg nicotine, 7.9 mg water and 4.2 mg glycerin, under FTC smoking conditions. The cigarettes each yield 18.8 mg FTC "tar" (of which 8.2 mg is glycerin). The cigarettes do not self-extinguish during the smolder period experienced during FTC smoking conditions.

EXAMPLE 3

A. Preparation of a Tobacco-Containing Smokable Material

Into tap water at ambient temperature and maintained at high shear in a blender is charged 11.8 parts sodium carboxymethylcellulose available as CMC 7HF from Hercules Inc. Then, 20.6 parts glycerin is charged into the mixture. After a consistent slurry is provided, 7.3 parts of the tobacco extract described in Example 1 within 35 parts ethanol is charged into the mixture. Then, 85.3 parts of the carbonaceous material described in Example 1 is folded into the mixture. Then, 15.0 parts of glass bubbles available as Code 25P35 from Potter's Industries is folded into the mixture.

The resulting slurry is cast to a 0.03 inch thickness onto a high density polyethylene sheet and air dried. The resulting material has a thickness of about 0.012 inch, a density of about 0.326 g/cm$^3$, and a moisture content of about 6 to about 10 percent. The sheet is divided into strip form, and the resulting strips are shredded at 32 cuts per inch to provide a smokable filler.

B. Preparation of a Cigarette

A cigarette of the configuration, dimensions, components and format of the type described in Example 2 is provided, except that the smokable rod includes the smokable material described in this Example rather than the smokable material described in Example 2. The smokable rod weighs about 0.67 g.

The cigarette is employed by burning the smokable rod. The burning cigarette has a fire core which exhibits good integrity.

EXAMPLE 4

A. Preparation of a Tobacco-Containing Smokable Material

A reconstituted tobacco material is provided using a papermaking process. A blend of 80 parts flue-cured tobacco laminae, 12 parts Maryland tobacco laminae and 8 parts Oriental tobacco laminae is extracted with tap water at ambient temperature to provide an aqueous tobacco extract and a tobacco pulp. The pulp is separated from the aqueous extract, and the pulp is contacted with calcium carbonate particles available as 15M Grade from Georgia Marble Co. The tobacco pulp and calcium carbonate particles are blended together and formed into a sheet using a papermaking process, the aqueous extraction is sprayed onto the sheet, and the sheet is dried. The resulting reconstituted tobacco sheet comprises an intimate mixture of about 50 parts tobacco material and about 50 parts calcium carbonate.

B. Preparation of a Smokable Material

Into tap water at ambient temperature and maintained at high shear in a blender is charged 23 parts of the carbonaceous material described in Example 1, 4 parts sodium carboxymethylcellulose available as CMC 7HF from Hercules, Inc., 6 parts glycerin and 67 parts of the calcium carbonate described in Example 2. The resulting slurry is cast as a sheet and shredded as described in Example 1. The resulting shreds of filler are dusted with caramelizing material, in the manner described in Example 1, such that about 10 percent of the resulting smokable material is caramelizing material.

C. Preparation of a Cigarette

Cigarettes substantially as shown in FIG. 2 are provided as follows:

The cigarettes each have a length of 84 mm and a circumference of 24.8 mm, and include a smokable rod having a length of 57 mm, a first filter segment having a length of 15 mm and a second filter segment having a length of 12 mm. Each filter element is attached to each smokable rod using nonporous tipping paper. For each cigarette, the tipping paper circumscribes the filter element and a 4 mm length of the smokable rod in the region adjacent the filter element. The filter elements are not ventilated.

The smokable rod includes a first segment which is a blend of 80 parts of the previously described reconstituted tobacco material and 20 parts of the previously described smokable material; and a second segment which consists solely of the previously described smokable material. Each segment extends about 28.5 mm along the length of the smokable rod.

The remaining configuration, dimensions, components and format are of the type described in Example 2. The cigarettes are smoked, and yield 12.6 puffs, 34.2 mg WTPM, 1.1 mg nicotine, 8.9 mg water, and each yield 24.2 mg FTC "tar" (of which 5.0 mg is glycerin).

EXAMPLE 5

A. Preparation of Smokable Materials

Into tap water at ambient temperature and maintained at high shear in a blender is charged 23 parts of the carbonaceous material described in Example 1, 4 parts sodium carboxymethylcellulose available as CMC 7HF from Hercules, Inc., 6 parts glycerin and 67 parts of the calcium carbonate described in Example 2. The resulting slurry is case as a sheet and shredded as described in Example 1. The resulting shreds of filler are dusted with caramelizing material, in the manner described in Example 1, such that about 10 percent of the resulting smokable material is caramelizing material.

A reconstituted tobacco material in sheet form is provided using a papermaking process. A blend of 75 parts Burley tobacco laminae and 25 parts flue-cured tobacco laminae is extracted with tap water at ambient temperature to provide an aqueous tobacco extract and a tobacco pulp. The pulp is separated from the aqueous extract, and the pulp is formed into a sheet using a papermaking process. The aqueous extract is sprayed onto the sheet, and the sheet is dried so as to have a thickness which approximates aged tobacco laminae.

B. Preparation of a Cigarette

Cigarettes substantially as shown in FIG. 3 are provided as follows:

The cigarettes each have a length of 84 mm and a circumference of 24.8 mm, and include a smokable rod having a length of 57 mm, a first filter segment having a length of 15 mm and a second filter segment having a length of 12 mm. Each filter element is attached to each smokable rod using nonporous tipping paper. For each cigarette, the tipping paper circumscribes the filter element and a 4 mm length of the smokable rod in the region adjacent the filter element.

The filter elements are provided using the wrapping materials and filter materials described in Example 1. However, for each cigarette, the smokable cut filler material is circumscribed by the previously described reconstituted tobacco material. In particular, a sheet of the reconstituted tobacco material having a length of about 57 mm and a width of about 25 mm is wrapped around the smokable filler material to provide a cylindrical rod. The smokable filler material within each rod weighs about 0.8 g and the reconstituted tobacco sheet within each rod weighs about 0.2 g. The resulting rod is in turn circumscribed by a cigarette paper wrap available as DD-100-2 from Kimberly-Clark Corp.

The cigarettes are employed by burning the smokable rod such that the smokable material within the paper wrapper burns to yield smoke. Cigarettes smoked and tested in this manner each yield 14.5 puffs, 49.7 mg WTPM, 1.4 mg nicotine, 18.3 mg water and 10.6 mg glycerin, under FTC smoking conditions. The cigarettes each yield 30 mg FTC "tar" (of which 10.6 mg is glycerin). On a per-puff basis, the cigarettes yield relatively low levels of combustion-derived FTC "tar."

EXAMPLE 6

The components used to provide the cigarette described in Example 5 are used to provide a cigarette having a configuration substantially as shown in FIG. 1. In particular, 0.8 g of the smokable cut filler material is blended with 0.2 g of the reconstituted tobacco material which has been shredded at 32 cuts per inch to provide a reconstituted tobacco cut filler. The cigarettes then are provided using the wrapping materials and filter materials described in Example 5.

The cigarettes are employed by burning the smokable rod such that the smokable material within the paper wrapper burns to yield smoke. Cigarettes smoked and tested in this manner each yield 13 puffs, 40.2 mg WTPM, 2.2 mg nicotine, 10.5 mg water and 7.5 mg glycerin, under FTC smoking conditions. The cigarettes each yield 27.5 mg FTC "tar" (of which 7.5 mg is glycerin).

EXAMPLE 7

A smokable material is provided as follows: Into 220 parts tap water at ambient temperature and maintained at high shear in a blender is charged 2.5 parts sodium carboxymethylcellulose available as CMC 7H4C from Hercules, Inc., 6 parts glycerin, 61.75 calcium carbonate from Georgia Marble Co. and screened to −80 to +170 US Mesh, and 30 parts of the carbonaceous material described in Example 1.

The resulting slurry is cast as a sheet, and dried to provide a sheet having a thickness of about 0.0166 inch.

EXAMPLE 8

A smokable material is provided as follows:

Into 200 parts tap water at ambient temperature and maintained at high shear in a blender is charged 2.6 parts sodium carboxymethylcellulose available as CMC 7HF from Hercules, Inc., 1.4 parts guar gum, 6 parts glycerin, 67 parts calcium carbonate as described in Example 7, and 23 parts carbonaceous material described in Example 1.

The resulting slurry is cast as a sheet, and dried to provide a sheet having a thickness of about 0.0174 inch.

EXAMPLE 9

A smokable material is provided as follows:

Into 200 parts tap water at ambient temperature and maintained at high shear in a blender is charged 2 parts sodium carboxymethylcellulose available as CMC 7HF from Hercules, Inc., 2 parts hydroxypropylcellulose available as Klucel H from Aqualon Co., 6 parts glycerin, 67 parts calcium carbonate described in Example 7, and 23 parts carbonaceous material described in Example 1.

The resulting slurry is cast as a sheet, and dried to provide a sheet having a thickness of about 0.0147 inch.

EXAMPLE 10

A cigarette substantially as shown in FIG. 2, and having the format and components substantially as described in Example 4 is provided. However, the reconstituted tobacco material employed to provide such a cigarette incorporates about 40 parts of the agglomerated matrix of calcium carbonate particles within a carbonaceous material, and about 60 parts tobacco material. The agglomerated calcium carbonate particles are described in Example 1; and the reconstituted tobacco material is provided using a papermaking process.

EXAMPLE 11

A cigarette substantially as described in Example 1 is provided. However, the smokable material thereof is prepared as follows:

Into about 300 parts of an aqueous tobacco extract (about 5 to about 10 percent dissolved tobacco solids in water) at ambient temperature and maintained at high shear in a blender is charged about 5.6 parts of the sodium carboxymethylcellulose described in Example 1. Then, about 8.4 parts glycerin is charged into the mixture. After a consistent slurry is provided, 5.6 parts fructose and about 2.8 parts glucose are charged into the mixture. The sugars are provided in a solution in about 35 parts hot water. Then, about 32.2 parts of the carbonaceous material described in Example 1 is folded into the mixture. Then, about 73.2 parts of the inorganic filler described in Example 1 is folded into the mixture. The resulting slurry is cast as a sheet and air dried.

EXAMPLE 12

A smokable material is provided as follows:

Into about 200 parts tap water at ambient temperature and maintained at high shear in a blender is charged about 11.7 parts methylcellulose available as Methocel A4M from The Dow Chemical Co., about 6 parts of malic acid in about 54 parts water, about 9.8 parts glycerin, about 77 parts calcium carbonate as described in Example 7, about 7 parts of the tobacco extract described in Example 1, and about 40.6 parts carbonaceous material described in Example 1.

The resulting slurry is cast as a sheet, and dried at above 45.20 C. to provide a smokable sheet.

What is claimed is:

1. An agglomerated matrix in particle form comprising particles of inorganic filler material spaced within a continuous or semi-continuous phase of a carbonaceous binding material.

2. The agglomerated matrix of claim 1 wherein the inorganic filler is calcium carbonate.

3. The agglomerated matrix of claim 2 wherein the agglomerated matrix has a calcium carbonate content of greater than about 90 weight percent.

4. A process for providing an agglomerated matrix having particles of inorganic filler material and a carbonaceous material, the process comprising the steps of:

(a) providing an agglomerated matrix of inorganic particles and organic binding material, and (b) subjecting he agglomerated matrix of step (a) to heat treatment sufficient to calcine the organic binding material.

5. The process of claim 4 whereby the agglomerated matrix of step (a) is provided by forming an aqueous slurry of inorganic particles and binding material and drying the slurry.

6. The process of claim 5 whereby the drying of the slurry is provided by spray drying the slurry.

7. The process of claim 4, 5 or 6 whereby the heat treatment is performed under gaseous non-oxidizing atmosphere.

8. The process of claim 4, whereby the inorganic material is calcium carbonate, and the agglomerated matrix provided in step (a) is such that the amount of calcium carbonate relative to binding matrix ranges from about 20:1 to about 1:1, on a dry weight basis.

9. The process of claim 4 or 5 whereby the organic binding material is a cellulosic derivative.

10. The process of claim 4 or 5 whereby the organic binding material is a sugar-containing material.

11. The process of claim 4, 5 or 6 whereby the heat treatment is performed under gaseous nitrogen which is heated to about 300° C. to about 425° C.

* * * * *